US009932936B2

(12) United States Patent
Klonis et al.

(10) Patent No.: US 9,932,936 B2
(45) Date of Patent: Apr. 3, 2018

(54) CARBURETOR CHOKE REMOVAL MECHANISM FOR PRESSURE WASHERS

(71) Applicant: Briggs & Stratton Corporation, Wauwatosa, WI (US)

(72) Inventors: George P. Klonis, New Berlin, WI (US); Timothy M. Schulte, Germantown, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 250 days.

(21) Appl. No.: 14/938,623

(22) Filed: Nov. 11, 2015

(65) Prior Publication Data

US 2017/0130675 A1 May 11, 2017

(51) Int. Cl.
*F02M 1/00* (2006.01)
*F02M 1/10* (2006.01)

(52) U.S. Cl.
CPC ..... *F02M 1/10* (2013.01); *B08B 2203/0241* (2013.01)

(58) Field of Classification Search
CPC ..... F02M 1/10; B08B 2203/0241
See application file for complete search history.

(56) References Cited

U.S. PATENT DOCUMENTS

| | | | | |
|---|---|---|---|---|
| 1,139,851 | A | 5/1915 | Dayton | |
| 1,334,555 | A | 3/1920 | Robbins et al. | |
| 1,851,711 | A | 3/1932 | Linga | |
| RE18,731 | E | 2/1933 | Weatherhead, Jr. | |
| 2,017,239 | A | 10/1935 | Fitzgerald | |
| 2,127,653 | A * | 8/1938 | Sisson | F02M 1/10 123/179.16 |
| 2,548,334 | A | 4/1951 | Armstrong | |
| 2,764,393 | A | 9/1956 | Geyer | |
| 2,783,984 | A | 3/1957 | Kramer | |
| 2,908,263 | A | 10/1959 | Brown | |
| 2,935,977 | A | 5/1960 | Eberline | |
| 2,979,047 | A | 4/1961 | Rapplean et al. | |
| 3,064,953 | A | 11/1962 | Hayes | |
| 3,118,433 | A | 1/1964 | Lechtenberg | |

(Continued)

FOREIGN PATENT DOCUMENTS

GB 0 186 716 10/1922

OTHER PUBLICATIONS

U.S. Final Office Action, U.S. Appl. No. 13/371,051, 28 pages (dated Oct. 23, 2014).

(Continued)

*Primary Examiner* — Hieu T Vo
*Assistant Examiner* — Sherman Manley
(74) *Attorney, Agent, or Firm* — Foley & Lardner LLP

(57) ABSTRACT

A choke removal mechanism for an autochoked engine includes an actuator arm which is configured to have an actuated state and an idle state, an actuator which is configured to be mechanically coupled to the actuator arm, a choke which is configured to have an open state and a closed state, and a choke spring which is configured to be mechanically coupled to the choke and the actuator arm, where the choke spring is configured to mechanically link the actuator arm to the choke such that when the actor arm is in the actuated state the choke is in the open state and when the actuator arm is in the idle state the choke is in the closed state.

16 Claims, 6 Drawing Sheets

(56) References Cited

U.S. PATENT DOCUMENTS

| | | | | | |
|---|---|---|---|---|---|
| 3,161,186 | A | | 12/1964 | Reichenbach et al. | |
| 3,194,224 | A | | 7/1965 | Lechtenberg et al. | |
| 3,199,530 | A | | 8/1965 | Svendsen | |
| 3,305,223 | A | | 2/1967 | Reichenbach | |
| 3,321,194 | A | * | 5/1967 | Carlson | F02M 1/00 236/92 D |
| 3,328,011 | A | * | 6/1967 | Winkler | F02M 1/10 261/39.3 |
| 3,807,709 | A | * | 4/1974 | Suda | F02M 1/10 261/39.2 |
| 3,823,700 | A | * | 7/1974 | Gumtow | F02M 1/02 123/395 |
| 3,863,614 | A | | 2/1975 | Thompson et al. | |
| 3,868,935 | A | * | 3/1975 | Liebman | F02M 1/10 261/39.3 |
| 4,031,872 | A | | 6/1977 | Thompson et al. | |
| 4,068,636 | A | | 1/1978 | Nau et al. | |
| 4,151,499 | A | | 4/1979 | Ganowsky et al. | |
| 4,254,064 | A | | 3/1981 | Bernauer et al. | |
| 4,450,117 | A | * | 5/1984 | Nakamura | F02M 1/10 261/121.4 |
| 4,612,770 | A | * | 9/1986 | Tadokoro | F02B 37/025 60/280 |
| 4,788,014 | A | * | 11/1988 | Kanno | F02M 1/10 261/39.2 |
| 4,860,608 | A | | 8/1989 | Kobayashi | |
| 4,961,409 | A | * | 10/1990 | Kobayashi | F02D 17/04 123/376 |
| 5,827,455 | A | | 10/1998 | Nakai | |
| 6,114,941 | A | | 9/2000 | Scott | |
| 6,116,581 | A | | 9/2000 | Watanabe et al. | |
| 6,145,487 | A | * | 11/2000 | Dykstra | F02D 9/02 123/179.18 |
| 6,202,989 | B1 | | 3/2001 | Pattullo | |
| 6,752,110 | B2 | | 6/2004 | Tharman et al. | |
| 6,990,969 | B2 | | 1/2006 | Roth et al. | |
| 7,331,326 | B2 | | 2/2008 | Arai et al. | |
| 7,344,125 | B2 | | 3/2008 | Matsuda et al. | |
| 7,628,387 | B1 | | 12/2009 | Clouse et al. | |
| 8,783,664 | B2 | | 7/2014 | Arai | |
| 9,316,175 | B2 | * | 4/2016 | Raasch | F02D 35/0076 |
| 2005/0144919 | A1 | | 7/2005 | Osborne | |
| 2005/0194701 | A1 | * | 9/2005 | Moriyama | F02M 1/10 261/39.4 |
| 2006/0283968 | A1 | | 12/2006 | Reichle | |
| 2008/0223336 | A1 | * | 9/2008 | Arai | F02M 1/10 123/376 |
| 2009/0146327 | A1 | * | 6/2009 | Roth | F02D 11/04 261/52 |
| 2009/0293828 | A1 | | 12/2009 | Iwata et al. | |
| 2009/0299614 | A1 | | 12/2009 | Iwata et al. | |
| 2011/0226217 | A1 | * | 9/2011 | Raasch | F02D 31/00 123/376 |
| 2011/0315176 | A1 | * | 12/2011 | Gilpatrick | B08B 3/026 134/57 R |
| 2012/0247423 | A1 | * | 10/2012 | Furuya | F02M 1/10 123/337 |
| 2012/0304963 | A1 | * | 12/2012 | Raasch | F02D 31/00 123/376 |
| 2013/0000586 | A1 | * | 1/2013 | Zuo | F02M 1/10 123/179.16 |
| 2013/0276751 | A1 | * | 10/2013 | Raasch | F02M 1/02 123/352 |

OTHER PUBLICATIONS

U.S. Office Action, U.S. Appl. No. 13/371,051, 22 pages (dated Jun. 2, 2015).

U.S. Office Action, U.S. Appl. No. 13/371,051, 20 pages (dated Apr. 9, 2014).

U.S. Office Action, U.S. Appl. No. 13/774,236, 15 pages (dated Aug. 13, 2015).

* cited by examiner

CARBURETOR CHOKE REMOVAL MECHANISM FOR PRESSURE WASHERS

BACKGROUND

The present disclosure generally relates to a choke removal mechanism for use in internal combustion engine equipment, such as pressure washers. Pressure washers are utilized in a variety of applications including commercial, residential, and municipal applications. More specifically, the present disclosure relates to incorporating a choke removal mechanism into a typical pressure washer.

SUMMARY

One embodiment of the present disclosure relates to a choke removal mechanism for an autochoked engine including an actuator arm, an actuator, a choke, and a choke spring. The actuator arm is configured to have an actuated state and an idle state. The actuator is configured to be mechanically coupled to the actuator arm. The choke is configured to have an open state and a closed state. The choke spring is configured to be mechanically coupled to the choke and the actuator arm. The choke spring is configured to mechanically link the actuator arm to the choke such that when the actuator arm is in the actuated state the choke is in the open state and when the actuator arm is in the idle state the choke is in the closed state.

Another embodiment of the present disclosure relates to a choke removal mechanism for an autochoked engine including an actuator arm, an actuator, a choke, a choke spring, a frame, a governor arm, and an idle down spring. The actuator arm is configured to have an actuated state and an idle state. The actuator is configured to be mechanically coupled to the actuator arm. The choke is configured to have an open state and a closed state. The choke spring is configured to be mechanically coupled to the choke and the actuator arm. The governor arm is configured to be mechanically coupled to the engine and rotatable between a minimum position and a maximum position. The idle down spring is configured to be mechanically coupled to the governor arm and the frame. A spring force exerted by the idle down spring biases the governor arm to the minimum position. The choke spring is configured to mechanically link the actuator arm to the choke such that when the actuator arm is in the actuated state the choke is in the open state and when the actuator arm is in the idle state the choke is in the closed state.

Yet another embodiment of the present disclosure relates to a method for choking an engine. The method may include autochoking the engine, transferring at least a portion of a displacement of an actuator to a choke, and preventing the choke from being engaged. Autochoking of the engine may occur while under a no load condition. Transferring at least a portion of a displacement of an actuator to a choke may occur while under a loading condition. Preventing the choke from being engaged while under the loading condition may occur once the engine has reached a desired operating temperature.

It is to be understood that both the foregoing general description and the following detailed description are exemplary and explanatory only, and are not restrictive of the invention as claimed.

DETAILED DESCRIPTION

Figure 1:
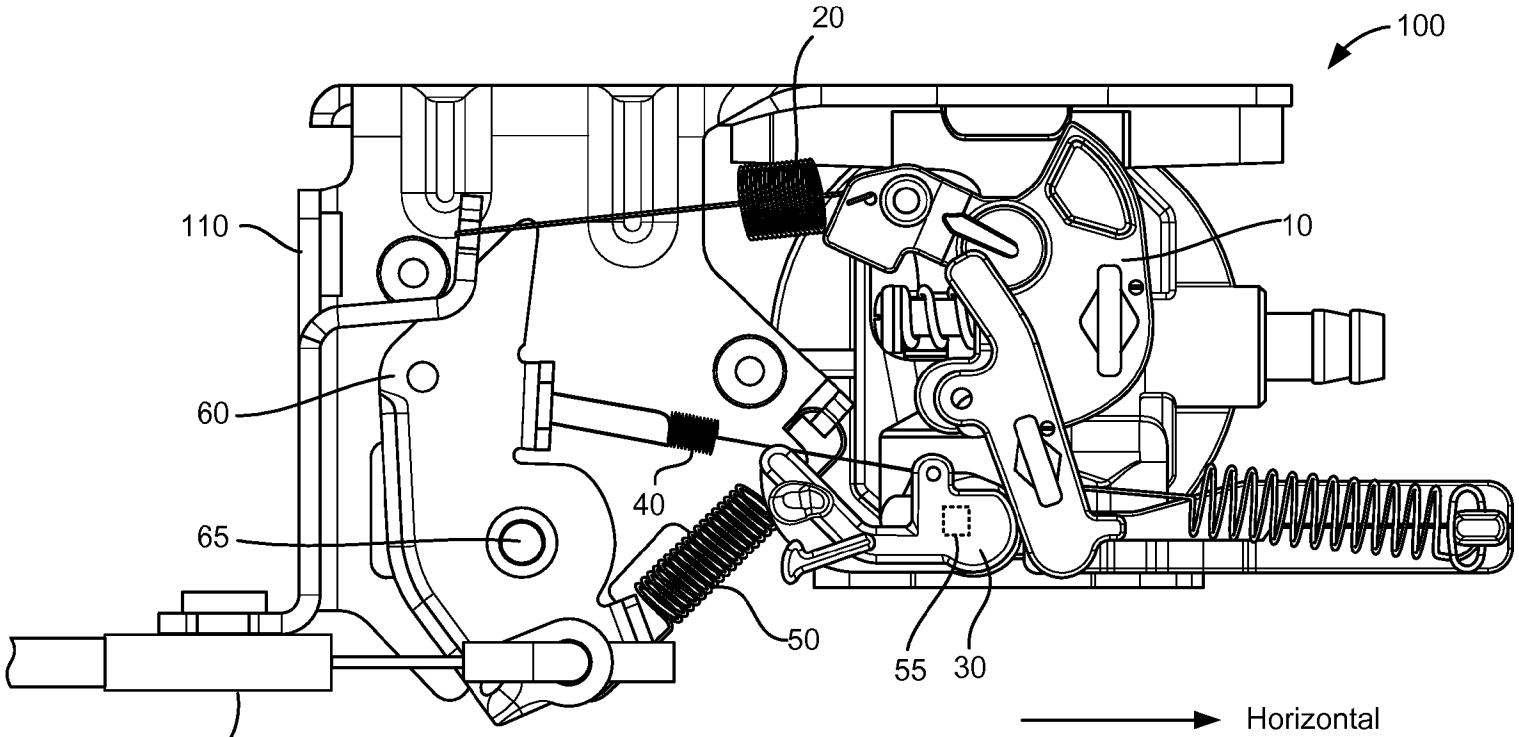
FIG. 1 is a side view of a throttle assembly in a first configuration, according to an exemplary embodiment of the present disclosure.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Pressure washers (e.g., power washers) typically contain internal combustion engines which contain components such as a choke, a throttle, and a thermostat. Pressure washers may be single speed or multi-speed. Upon being started (i.e., turned on, powered, etc.) cold internal combustion engines take a certain amount of time to "warm-up," allowing for the engine and its components to reach an optimal operating temperature. During the warm-up time, before the components of the engine have reached their optimal operating temperature, the engine is operating "cold." Typical pressure washers include a thermostat designed to disengage the choke completely once the engine reaches a certain temperature threshold.

Pressure washers use high-pressure liquid, typically water, to clean surfaces such as driveways, decks, walls, and the like. Generally, the pressure washer includes an engine that provides power to a pump. The pump operates to provide high-pressure fluid to a wand or a gun that includes a trigger mechanism that is actuated by the operator to discharge the high-pressure fluid. Generally, the operator squeezes the trigger with one hand and supports the discharge end of the gun with the other hand during use. During periods when high-pressure water is not required, the operator releases the trigger and high-pressure water from the pump discharge is directed back to a pump intake.

The desired operating temperature of an engine is typically the temperature at which the engine and all of the components associated with the engine have reached temperatures where they may operate within specified parameters. Before the engine and the various components associated with the engine reach the desired operating temperature, operation may be inefficient and/or irregular. For example, before an engine reaches the desired operating temperature, it may be difficult to start the engine. In order to facilitate the starting of a cold engine, the engine may include a choke. The choke may restrict the amount of air that enters the engine. In some cases, the choke is applied only when starting the engine. In other cases, the choke may applied when starting the engine and for a period of time after starting the engine.

In application, a load may be placed on an engine from a variety of sources. For example, when a blade on a lawnmower is engaged, via the operator articulating a bail or trigger, a load is placed on the engine. In certain situations, it may be possible for a cold engine to encounter be loaded. For example, shortly after starting the engine of a lawnmower and before the engine has reached a desired operating temperature; an operator may engage a blade on the lawnmower, placing a load on the cold engine. When a cold engine is loaded, air may be restricted from entering the engine by the choke, resulting in a dramatic decrease in performance. Typically, once the engine reaches the desired operating temperature, a thermostat engages a mechanism that prevents the choke from closing past a certain point. This mechanism may be a bi-metallic strip, an actuated pin, or other suitable mechanism.

The load placed on the engine may be partially influenced by a throttle position of the engine. In some applications, such as typical pressure washers, the throttle is either fully opened (i.e., wide open throttle (WOT)) or fully closed. Generally, a pressure washer operator articulates a trigger (i.e., a switch, a lever, etc.) that either fully opens the throttle, in order to utilize the pressure washer, or fully closes the throttle, in order to cease utilizing the pressure washer. While operating a pressure washer during the warm-up time, a typical pressure washer applies the choke. The choke is intended to be a mixture control system for a fuel and air mixture, a type of which is found on typical carburetors. Generally, the choke provides for a quicker and easier starting process for the engine than for engines without a choke, especially if the engine has not been started for a prolonged period of time. Additionally, applying the choke promotes fuel movement throughout the system, which may be advantageous after prolonged periods of time between uses, such as storage. When the engine is choked (i.e., when the choke is applied), more fuel and less air are provided to the engine. After starting the engine, the choke is typically disengaged slowly as the engine begins to reach its operating temperature. Disengaging the choke at a rapid rate may lead to the engine stalling due to receiving too much fuel.

In some applications, the engine may include an autochoke mechanism. The autochoke mechanism may be implemented in various forms. For example, the autochoke mechanism may be a flap which is manipulated by airflow from a centrifugal fan connected to a component rotating at a speed directly related to the speed of the engine. In application, the flap may allow the autochoke mechanism to be gradually removed as the speed of the engine increases. Once the engine, or a component associated with the engine, has reached a desired operating temperature, the autochoke mechanism is disengaged and the speed of the engine is no longer tied to the effect of the autochoke mechanism.

Autochoke mechanisms may allow for the choke to be gradually removed automatically by the engine, rather than by the operator. A typical autochoke mechanism operates based on airflow generated by a flywheel coupled to the engine; however, some autochoke mechanisms operate based on temperature and are articulated by a solenoid. Utilizing an autochoke mechanism in a pressure washer presents certain issues that may not be present in other applications. One such issue is that pressure washers are relatively high load applications, meaning that when loaded (e.g., when the operator pulls the trigger of the pressure washer), a high load is instantaneously applied to the engine by a pump because the throttle is at the WOT position.

The period of time when the operating temperature is below the desired operating temperature may be referred to as a warm-up time of the engine. During the warm up time, if a load is instantaneously transferred to the engine, engine speed may drop to a point such that the autochoke mechanism is further engaged, restricting the air flow to the engine. This may cause the choke to limit the air in the air-fuel mixture and force the engine to run on a higher fuel-to-air ratio mixture rather than on a more powerful lower fuel-to-air ratio mixture. During use, if the choke is at least partially engaged, engine performance is typically less than optimal. In some situations, such as with a pressure washer equipped with an autochoke mechanism, applying a high load during the warm-up time results in greatly reduced power and pressure of the pressure washer, possibly even causing the engine to "stumble."

In typical pressure washer applications, it is common for the engine warm-up time to last approximately three to four minutes, after which the thermostat has reached a specified temperature and the engine removes the choke, allowing for the engine, which is now warm, to operate at full capacity. Once the engine is warm, loads may be transferred onto and off of the engine without the choke being engaged.

Implementation of an autochoke mechanism may involve difficulties if a load is applied while the engine is cold. For example, in the case of a flap-based autochoke mechanism, as the speed of the engine increases, air pressure to the flap is increased and the autochoke mechanism is gradually removed. However, if a load is placed on the engine, while the engine is cold the speed of the engine, and therefore the speed of the fan, will be undesirably decreased, resulting in a loss of air pressure to the flap and an increased effect of the autochoke mechanism on the engine. The increased effect of the autochoke mechanism on the engine may result in the engine stalling or performing at a less than desired level. Accordingly, a need exists for a mechanism which may prevent the increased effect of the autochoke mechanism on an engine when the engine is cold and a load is applied to the engine.

Figure 2:
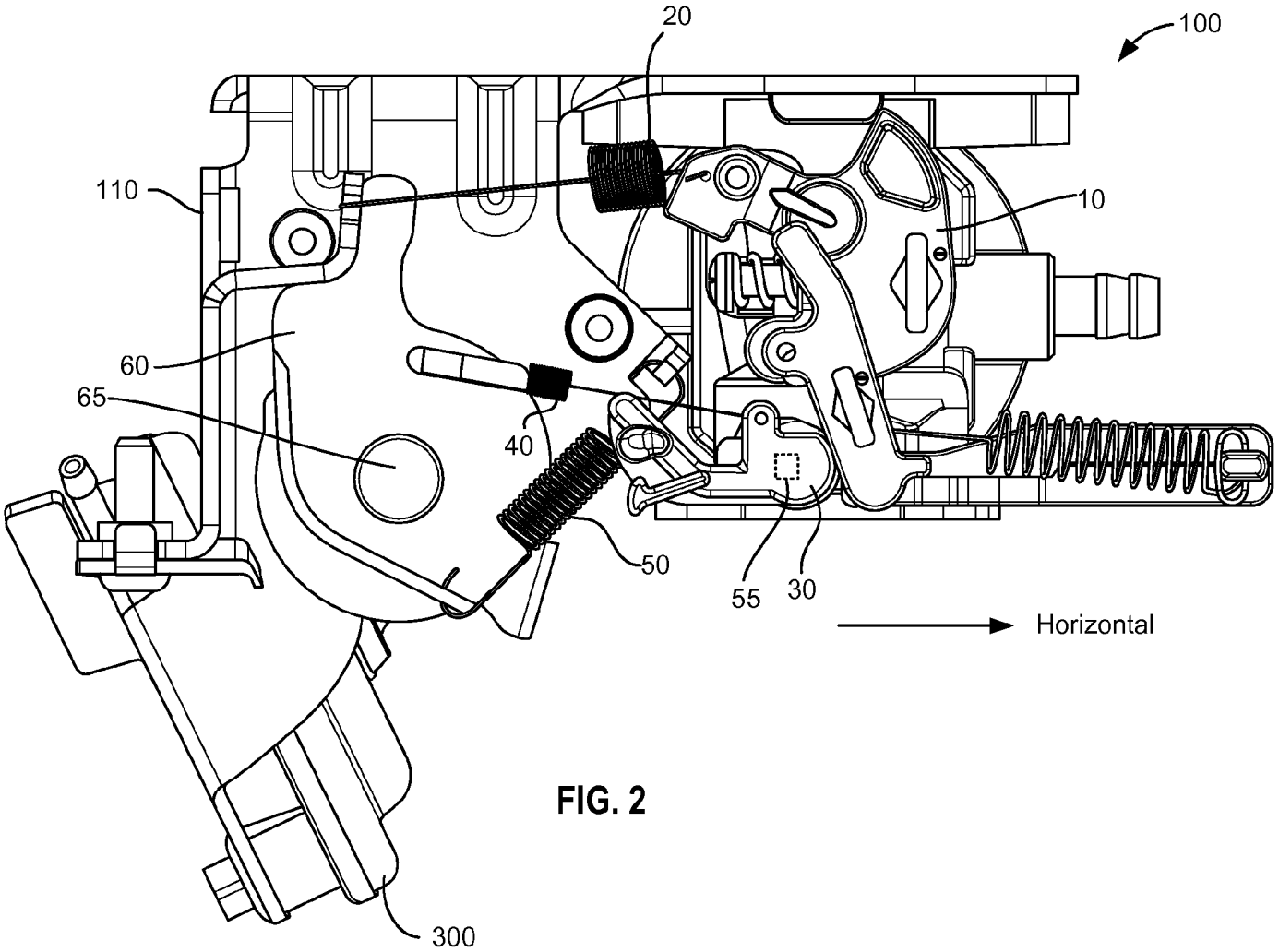
FIG. 2 is a side view of another throttle assembly in a first configuration, according to an exemplary embodiment of the present disclosure.

FIGS. 1-2 illustrates a mechanism, shown as choke removal mechanism 100, for use in an engine including an autochoke mechanism. According to an exemplary embodiment, choke removal mechanism 100 includes a first bracket, shown as governor arm 10, a first spring, shown as governor spring 20, a second bracket, shown as choke 30, a second spring, shown as choke spring 40, a third spring, shown as actuator spring 50, a third bracket, shown as actuator arm 60, an actuator, shown as cable pull actuator 200, and a frame, shown as frame 110. Choke removal mechanism 100 may be used with an engine in a pressure washer (e.g., power washer, etc.) or in connection with other applications. The engine, or a component associated with the engine, has an operating temperature which is the current temperature of the engine or the component associated with the engine, and a desired operating temperature, which is a target temperature for the engine or the component associated with the engine. When the operating temperature is less than the desired operating temperature, the engine is cold. The autochoke mechanism is engaged when the operating temperature is less than the desired operating temperature and is disengaged when the operating temperature is greater than the desired operating temperature. According to an exemplary embodiment, governor spring 20 does not interfere with the thermal management or properties of the engine (i.e., blocking coolant air to the engine) and does not interfere with a thermostat, shown as thermostat 55, of the engine. It is understood that the relative location and size of thermostat 55 is for illustrative purposes only, and that thermostat 55 may be of any suitable shape, size, configuration, or be in any suitable location, such that thermostat 55 may be tailored for a target application.

Choke 30 may be operable between an open position where choke 30 does not substantially affect the airflow to the engine and a closed position where choke 30 blocks substantially all air flow into the engine. As shown in FIGS. 1-4, choke 30 is in the open position. According to an exemplary embodiment, the open position is defined by choke 30 being substantially horizontal in relation to frame 110 and the closed position is defined by 30 being disposed at an angle relative to the horizontal in relation to frame 110. The angle that defines the closed position of choke 30 may be varied such that choke removal mechanism 100 is tailored for a target application.

In application, a load may be placed on the engine when the operating temperature is less than the desired operating temperature. The load may be applied to the engine through cable pull actuator 200 and actuator arm 60. Cable pull actuator 200 may be actuated (e.g., extended, retracted, engaged, disengaged, etc.) when an operator articulates a mechanism such as a trigger or bail (e.g., bail control arm, etc.). Cable pull actuator 200 may be a throttle control or other suitable control such as a power take-off (PTO) control. The load may be in the form of a throttle load, caused by the throttle being articulated to a position, such as WOT. The load may also be in the form of an external load, caused by an external load being applied to the engine. When cable pull actuator 200 is actuated, actuator arm 60 may be rotated about a point 65. The rotation of actuator arm 60 may be resisted and/or assisted by actuator spring 50. When the load is applied to the engine when it is cold, the autochoke mechanism may engage choke 30. In order to prevent the autochoke mechanism from engaging the choke, choke removal mechanism 100 includes choke spring 40. Choke spring 40 biases choke 30 in the open position when actuator arm 60 is rotated by cable pull actuator 200. In this manner, choke 30 may remain open when the engine is cold and a load is applied to the engine.

Choke removal mechanism 100 allows for choke 30 and the autochoke mechanism to function normally while not under load and insures the open choke position while the engine is loaded regardless of engine temperature. By incorporating choke removal mechanism 100 into the engine, the engine will not be inadvertently choked and can operate at full capacity regardless of load. As such, as engine speed increases the choke increasingly opens, regardless of engine temperature. However, if the engine experiences a load while still cold, the engine speed will decrease thereby causing the choke to close. When the operating temperature is equal to or greater than the desired operating temperature, thermostat 55 removes (e.g., disengages, etc.) choke 30, allowing loads to be transferred on and off of the engine without being impacted by choke 30. Choke removal mechanism 100 may allow for the engine to operate with choke 30 engaged at partial load, provide an optimum environment for starting the engine, and result in an engine warm-up time which is dramatically decreased compared to that of typical pressure washers.

According to various embodiments, the motion of governor arm 10 is directly affected by governor spring 20. Governor spring 20 is mechanically coupled (e.g., inserted, wrapped around, or otherwise attached) to governor arm 10 and to frame 110. According to various embodiments, the motion of actuator arm 60 is affected by actuator spring 50. Actuator spring 50 is mechanically coupled (e.g., inserted, wrapped around, or otherwise attached) to actuator arm 60 and to frame 110. According to various embodiments, the motion of actuator arm 60 is further affected by cable pull actuator 200. Cable pull actuator 200 is mechanically coupled (e.g., inserted, secured, fastened, wrapped around, or otherwise attached) to actuator arm 60 and to frame 110. According to various embodiments, the motion of choke 30 is directly affected by choke spring 40. Choke spring 40 is mechanically coupled (e.g., inserted, wrapped around, or otherwise attached) to actuator arm 60 and to choke 30. Governor spring 20, choke spring 40, and actuator spring 50 are individually defined by a spring constant and individually exert a spring force which is a function of the corresponding spring constant. It is understood that each spring constant may be varied such that governor spring 20, choke spring 40, and/or actuator spring 50 may have different spring forces that are individually or collectively tailored for a target application.

As shown in FIG. 2, choke removal mechanism 100 is shown to include a vacuum pull actuator 300 in place of cable pull actuator 200. It is understood that choke removal mechanism 100 could utilize any suitable actuator in place of cable pull actuator 200 or vacuum pull actuator 300, such as hydraulic actuators, pneumatic actuators, electric actuators, thermal actuators, magnetic actuators, mechanical actuators, solenoids, general purpose linear actuators, and other suitable actuating mechanisms such that choke removal mechanism 100 is tailored for a target application.

Figure 3:
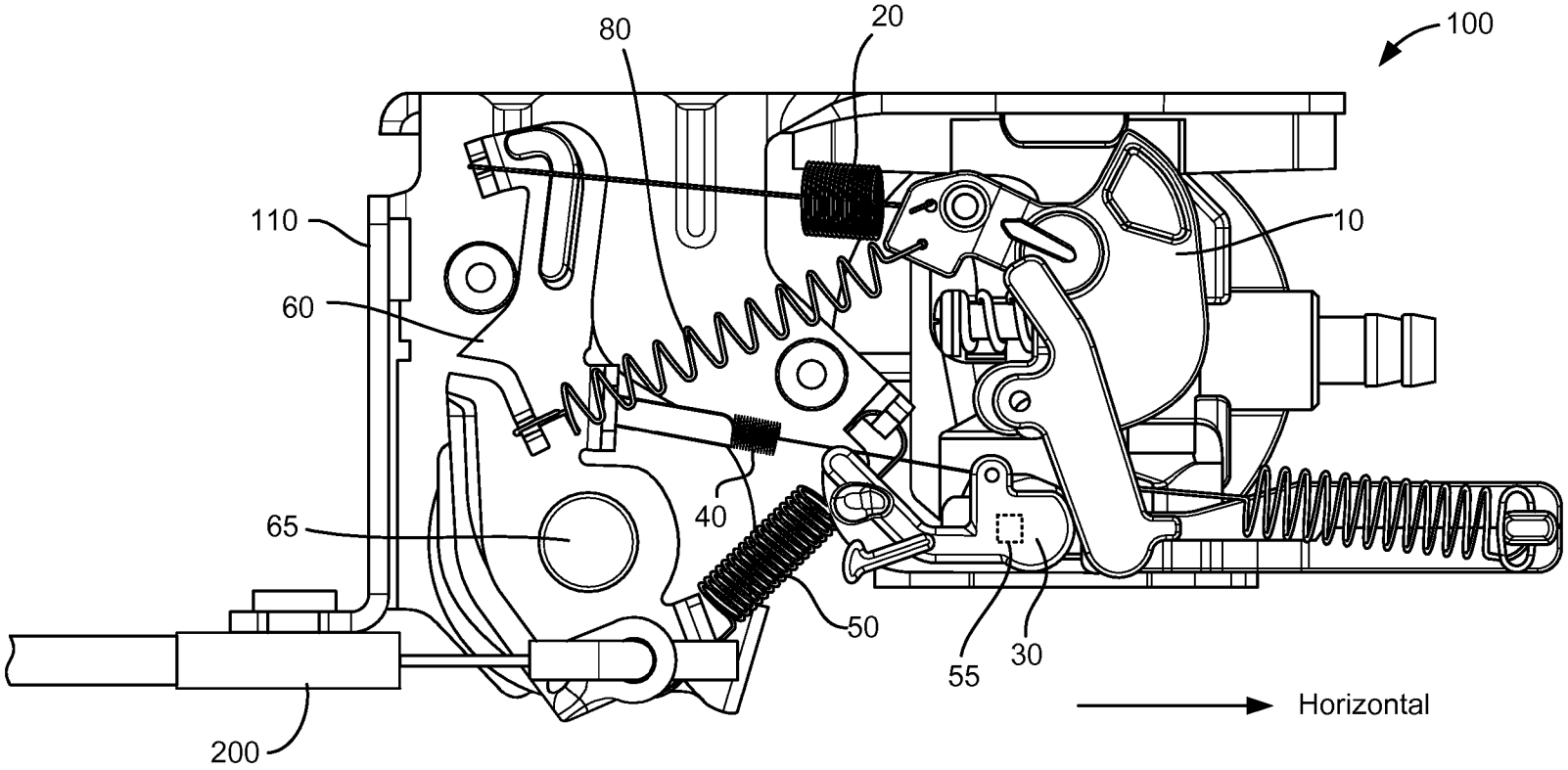
FIG. 3 is a side view of the throttle assembly of FIG. 1 in a second configuration, according to an exemplary embodiment of the present disclosure.
Figure 4:
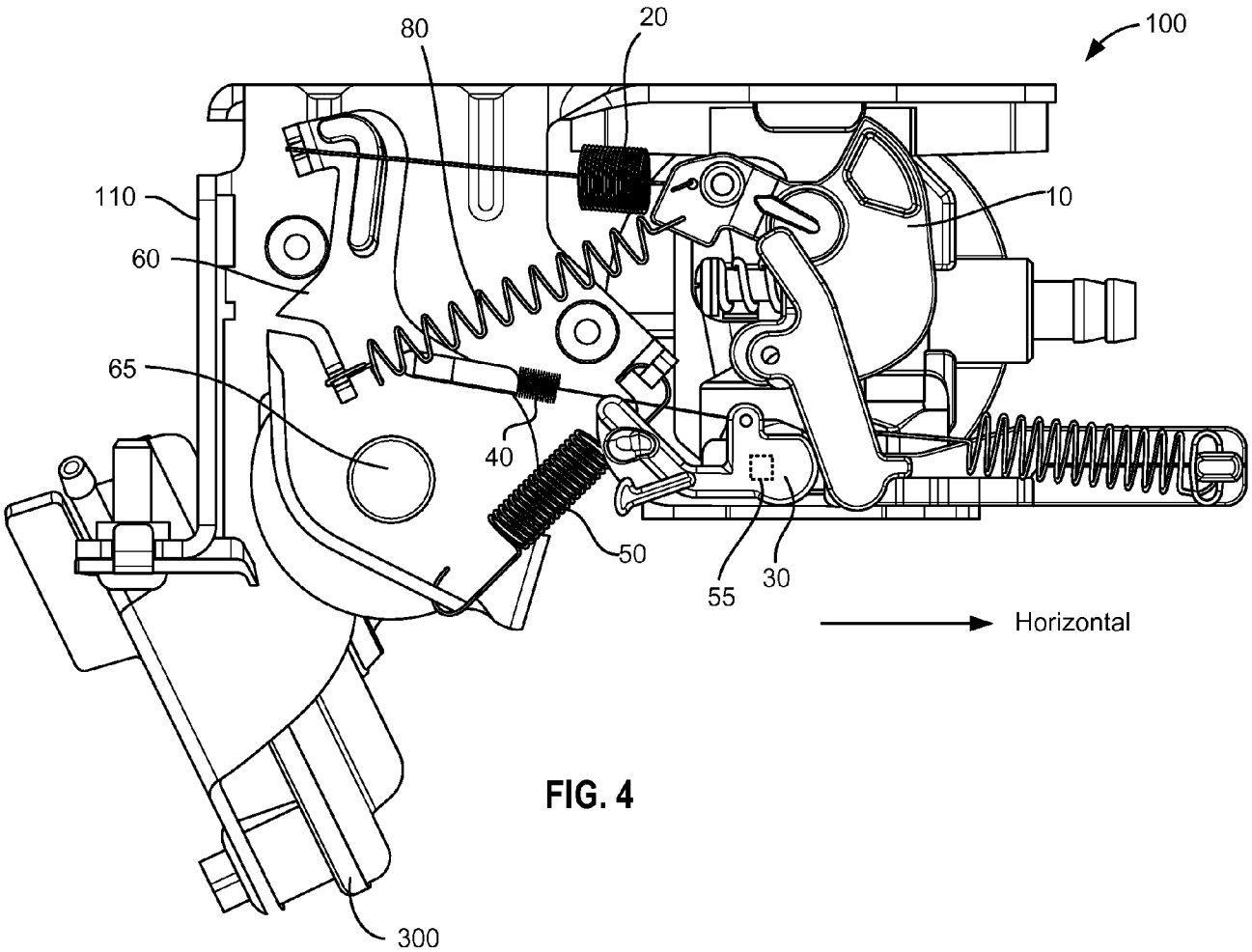
FIG. 4 is a side view of the throttle assembly of FIG. 2 in a second configuration, according to an exemplary embodiment of the present disclosure.

FIGS. 3-4 illustrate choke removal mechanism 100 further including an idle down spring 80. Typical pressure washers may include idle down spring 80 to override the governor to force the throttle to the idle position. Idle down spring 80 may be used in pressure washers which have an idle-down mode in which the water pump speed is decreased when the water pump is not in use. By including idle down spring 80 in the pressure washer, the speed of the engine may be reduced when high-pressure fluid is not required, which may increase the useful life of the engine and pump. Inclusion of choke removal mechanism 100 and idle down spring 80 in an engine provides improved performance of the idle-down mode which, without choke removal mechanism 100, may not facilitate engine speed ramps under load with the choke on. According to an exemplary embodiment, idle down spring 80 is coupled to frame 110 and governor arm 10.

Figure 5A:
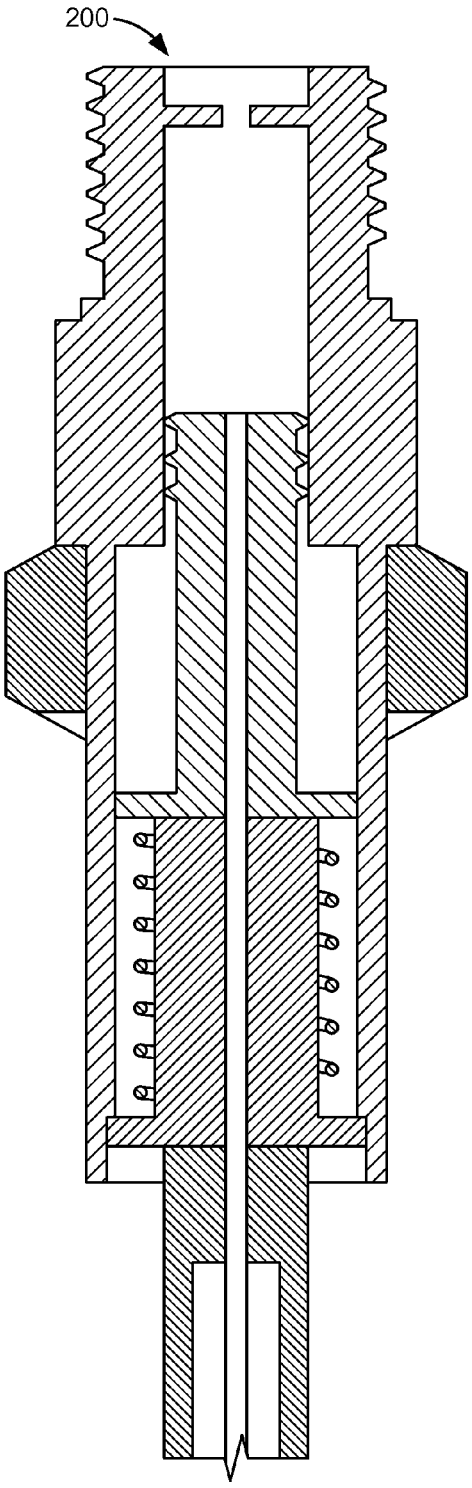
FIG. 5A is a cross-sectional view of a vacuum pull actuator that is shown at the wide open throttle (WOT) position, according to an exemplary embodiment of the present disclosure.
Figure 5B:
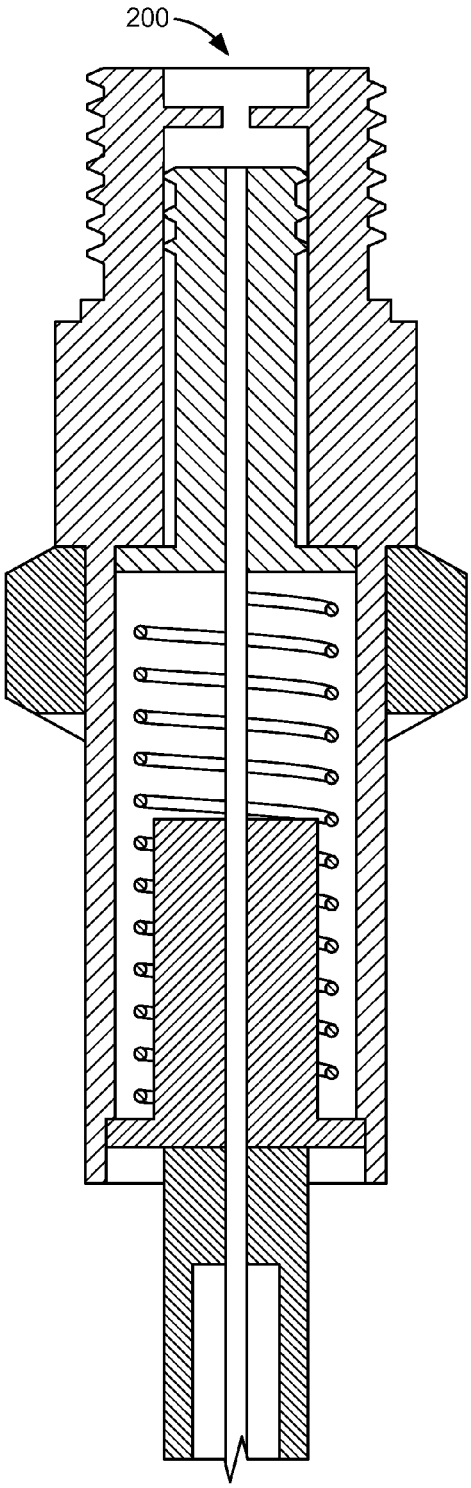
FIG. 5B is a cross-sectional view of the vacuum pull actuator of FIG. 5A, shown at the idle position, according to an exemplary embodiment of the present disclosure.

Referring to FIGS. 5A-5B, a cross-sectional view of cable pull actuator 200 is shown. Referring to FIG. 5A cable pull actuator 200 is shown at the WOT position. Referring to FIG. 5B cable pull actuator 200 is shown at the idle position. As cable pull actuator 200 transitions from WOT to idle, a displacement is created by cable pull actuator 200. In application, cable pull actuator 200 may translate input from the operator to various controls of the engine. For example, cable pull actuator 200 may be connected to a trigger or bail which may be articulated by the operator to manipulate throttle control of the engine. In application, the displacement created by cable pull actuator 200 may result in a throttle change of the engine. In operation, the articulation of a trigger or bail translates a cable within cable pull actuator 200. This translation may result in a translation of an opposite end of the cable, which may be connected to an output. Cable pull actuator 200 may be a Bowden cable.

Figure 6A:
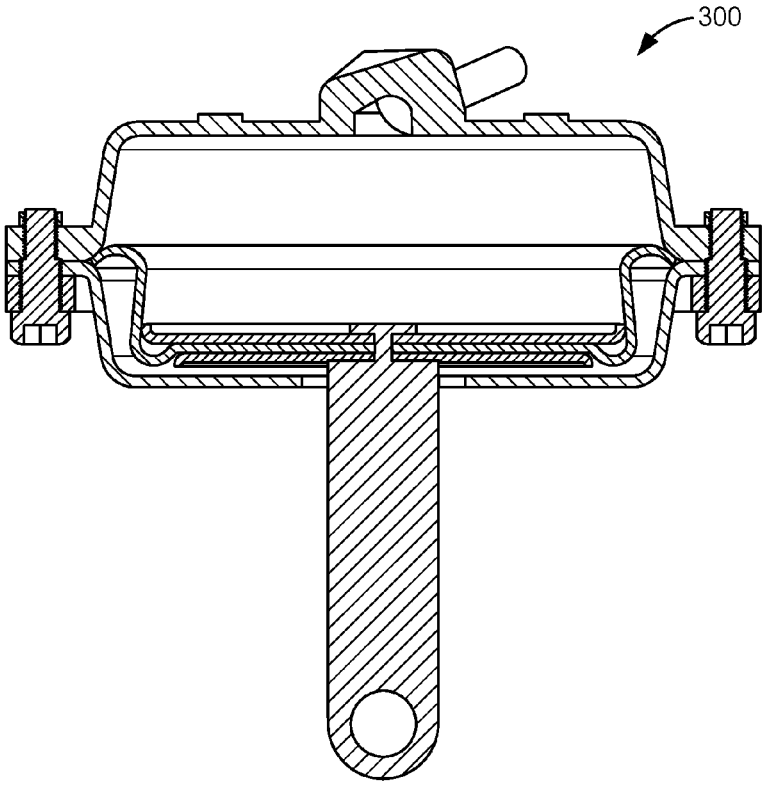
FIG. 6A is a cross-sectional view of a cable pull actuator that is shown at the WOT position, according to another exemplary embodiment of the present disclosure.
Figure 6B:
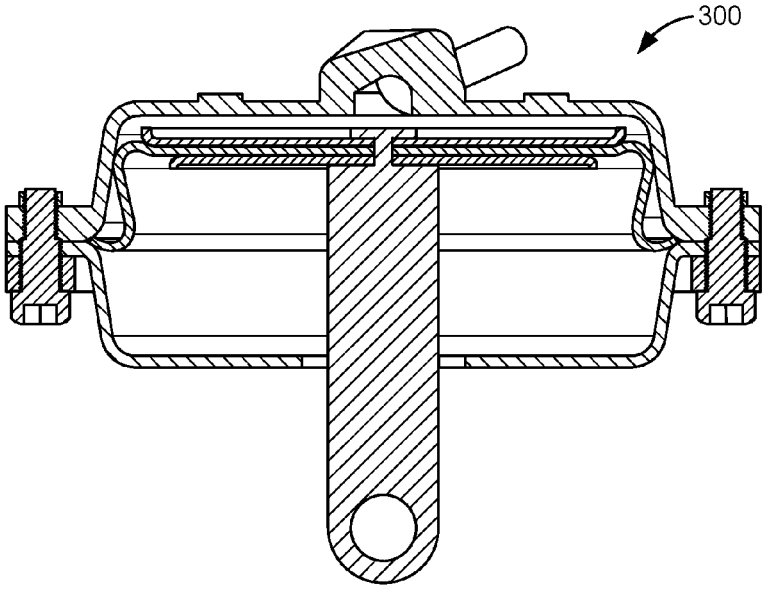
FIG. 6B is a cross-sectional view of the cable pull actuator of FIG. 6A, shown at the idle position, according to an exemplary embodiment of the present disclosure.

Referring to FIGS. 6A-6B, a cross-sectional view of vacuum pull actuator 300 is shown. Referring to FIG. 6A vacuum pull actuator 300 is shown at the WOT position. Referring to FIG. 6B vacuum pull actuator 300 is shown at the idle position. As vacuum pull actuator 300 transitions from WOT to idle, a displacement is created by vacuum pull actuator 300. In application, vacuum pull actuator 300 may translate input from the operator to various controls of the engine. For example, vacuum pull actuator 300 may be connected to a trigger or bail which may be articulated by the operator to manipulate throttle control of the engine. In application, the displacement created by vacuum pull actuator 300 may result in a throttle change of the engine. In application, vacuum pull actuator may be connected to a vacuum system which may create a vacuum, may include a canister or a reservoir and a series of tubes. In operation, the vacuum system may create a vacuum pressure which may be transferred to vacuum pull actuator 300 through the series of tubes, which is then transferred to an output. In many applications, the vacuum system includes a solenoid valve which controls the vacuum pressure output to vacuum pull actuator 300.

In addition to the actuators shown and described, other types of actuators or similar mechanisms could also be used in place of cable pull actuator 200 and/or vacuum pull actuator 300. For example, hydraulic actuators, pneumatic actuators, thermal actuators, magnetic actuators, and electrical actuators such as solenoids, could all be utilized by the choke removal mechanism.

In some embodiments, a pressure washer includes a frame, a prime mover supported by the frame and including a power takeoff, a water pump coupled to the power take off and including a pump inlet and a pump outlet, a supply conduit fluidly coupled to the pump inlet and configured to be coupled to a primary fluid supply, a flow multiplier including a mixing chamber having a fluid outlet, a primary fluid inlet fluidly coupled to the pump outlet, a primary fluid restriction downstream of the primary fluid inlet, a primary fluid nozzle downstream of the primary fluid restriction, the primary fluid nozzle extending into the mixing chamber and having a nozzle outlet located within the mixing chamber, and a secondary fluid inlet in fluid communication with the mixing chamber, a secondary fluid conduit fluidly coupled to the supply conduit and the secondary fluid inlet, a check valve along the secondary fluid conduit and located upstream of the secondary fluid inlet, the check valve configured to close the secondary fluid conduit in response to a mixing chamber pressure above a threshold pressure, a delivery conduit fluidly coupled to the fluid outlet, and a spray gun fluidly coupled to the delivery conduit downstream of the fluid outlet, the spray gun including at least two nozzles, the first nozzle having a first flow area and the second nozzle having a second flow area greater than the first flow area, the fluid exiting the spray gun through one of the at least two nozzles. In a high-pressure operating mode, primary fluid flows from the primary fluid source to the water pump through the supply conduit, is pressurized in the water pump, exits the water pump, enters the flow multiplier via the primary fluid inlet, passes through the primary fluid restriction to the primary fluid nozzle, exits the primary fluid nozzle outlet into the mixing chamber, exits the mixing chamber through the fluid outlet, passes through the delivery conduit to the spray gun, and exits the spray gun through the first nozzle, thereby causing the mixing chamber pressure to exceed the threshold pressure. In a high-flow operating mode, primary fluid flows from the primary fluid source to the water pump through the supply conduit, is pressurized by in the water pump, exits the water pump, enters the flow multiplier via the primary fluid inlet, passes through the primary fluid restriction to the primary fluid nozzle, and exits the primary fluid nozzle outlet into the mixing chamber and secondary fluid flows from the supply conduit, through the check valve, and into the mixing chamber through the secondary fluid inlet so that the secondary fluid is entrained with the primary fluid, resulting in a combined fluid flow that exits the mixing chamber through the fluid outlet, passes through the delivery conduit to the spray gun, and exits the spray gun through the second nozzle, thereby maintaining the mixing chamber pressure below the threshold pressure.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A choke removal mechanism for an autochoked engine, comprising:

an actuator arm having an actuated state and an idle state;

an actuator configured to be mechanically coupled to the actuator arm;

a choke having an open state and a closed state; and a choke spring configured to be mechanically coupled to the choke and the actuator arm;

wherein the choke spring mechanically links the actuator arm to the choke such that when the actuator arm is in the actuated state the choke is in the open state and when the actuator arm is in the idle state the choke is in the closed state.

2. The choke removal mechanism of claim 1, further comprising:

a frame;

a governor arm mechanically coupled to the engine and rotatable between a minimum position and a maximum position; and an idle down spring mechanically coupled to the governor arm and the frame;

wherein a spring force exerted by the idle down spring biases the governor arm to the minimum position.

3. The choke removal mechanism of claim 2, further comprising:

a thermostat configured to monitor the temperature of at least one of the engine and a component associated with the engine;

wherein when the thermostat determines the temperature of at least one of the engine and the component associated with the engine reaches a desired operating temperature the choke is decoupled from the engine.

4. The choke removal mechanism of claim 1, wherein the actuator is a cable pull actuator.

5. The choke removal mechanism of claim 1, wherein the actuator is a vacuum pull actuator.

6. A choke removal mechanism for a pressure washer, comprising:

an actuator arm having an actuated state and an idle state;

an actuator configured to be mechanically coupled to the actuator arm;

a choke having an open state and a closed state;

a choke spring configured to be mechanically coupled to the choke and the actuator arm;

a frame;

a governor arm mechanically coupled to the engine and rotatable between a minimum position and a maximum position; and an idle down spring configured to be mechanically coupled to the governor arm and the frame;

wherein a spring force exerted by the idle down spring biases the governor arm to the minimum position; and wherein the choke spring mechanically links the actuator arm to the choke such that when the actuator arm is in the actuated state the choke is in the open state and when the actuator arm is in the idle state the choke is in the closed state.

7. The choke removal mechanism of claim 6, further comprising:

a thermostat configured to monitor the temperature of at least one of the engine and a component associated with the engine;

wherein when the thermostat determines the temperature of at least one of the engine and the component associated with the engine reaches a desired operating temperature the choke is decoupled from the engine.

8. The choke removal mechanism of claim 6, wherein the actuator is a cable pull actuator.

9. The choke removal mechanism of claim 6, wherein the actuator is a vacuum pull actuator.

10. A method for choking an engine comprising: autochoking the engine while under a no load condition;

transferring at least a portion of a displacement of an actuator to a choke while under a loading condition;

preventing the choke from being engaged while under the loading condition once the engine has reached an optimal operating temperature; and controlling the speed of the engine through the use of an idle down spring coupled to a frame and a governor arm, wherein the governor arm is coupled to a governor of the engine configured to control the speed of the engine and wherein the governor arm has minimum position and a maximum position;

wherein transferring the displacement of the actuator to the choke is a result of a choke spring transferring displacement of an actuator arm to the choke;

wherein preventing the choke from being engaged under the loading condition includes disengaging the choke when a thermostat senses a desired operating temperature;

wherein the thermostat is configured to sense the temperature of at least one of the engine and a component associated with the engine.

11. The method of claim 10, further comprising biasing the governor arm to the minimum position through the use of the idle down spring.

12. The method of claim 11, wherein the displacement of the governor arm is caused by a spring force exerted by the idle down spring to bias the governor to a minimum position.

13. The method of claim 12, further comprising decreasing the speed of the engine when the actuator is in a retracted state.

14. The method of claim 13, further comprising increasing the speed of the engine when the actuator is in an actuated state.

15. The method of claim 10, wherein the actuator is a cable pull actuator.

16. The method of claim 10, wherein the actuator is a vacuum pull actuator.

* * * * *